US009803629B2

(12) United States Patent
Yamamoto et al.

(10) Patent No.: US 9,803,629 B2
(45) **Date of Patent: *Oct. 31, 2017**

(54) VARIABLE DISPLACEMENT SWASH PLATE COMPRESSOR

(71) Applicant: KABUSHIKI KAISHA TOYOTA JIDOSHOKKI, Aichi-ken (JP)

(72) Inventors: Shinya Yamamoto, Kariya (JP); Takahiro Suzuki, Kariya (JP); Kazunari Honda, Kariya (JP); Kei Nishii, Kariya (JP); Yusuke Yamazaki, Kariya (JP); Masaki Ota, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 304 days.

This patent is subject to a terminal disclaimer.

(21) Appl. No.: 14/666,819

(22) Filed: Mar. 24, 2015

(65) Prior Publication Data

US 2015/0275876 A1 Oct. 1, 2015

(30) Foreign Application Priority Data

Mar. 28, 2014 (JP) ..... 2014-070181

(51) Int. Cl.
*F04B 1/26* (2006.01)
*F04B 27/18* (2006.01)
(Continued)

(52) U.S. Cl.
CPC ..... *F04B 27/1804* (2013.01); *F04B 27/0878* (2013.01); *F04B 27/1036* (2013.01);
(Continued)

(58) Field of Classification Search
CPC ..... F04B 27/1804; F04B 39/0094; F04B 27/0878; F04B 27/1054; F04B 27/12;
(Continued)

(56) References Cited

U.S. PATENT DOCUMENTS 4,037,993 A 7/1977 Roberts
4,061,443 A 12/1977 Black et al.
(Continued)

FOREIGN PATENT DOCUMENTS

CN 103807132 5/2014
CN 103807134 5/2014
(Continued)

OTHER PUBLICATIONS

Official Action, along with English-language translation thereof, for CN Appl. No. 201510133584.4 dated Aug. 2, 2016.
(Continued)

*Primary Examiner* — Charles Freay
(74) *Attorney, Agent, or Firm* — Greenblum & Bernstein, P.L.C.

(57) ABSTRACT

A variable displacement swash compressor includes a housing, a drive shaft, a swash plate, a link mechanism, pistons, a conversion mechanism, an actuator, and a control mechanism. The housing includes a suction chamber, a discharge chamber, a swash plate chamber, and cylinder bores. The control mechanism controls the actuator. The actuator includes a partitioning body, a movable body, and a control pressure chamber. At least one of the suction chamber and the swash plate chamber is a low pressure chamber. The control mechanism includes a control passage, which connects the control pressure chamber, the low pressure chamber, and the discharge chamber, and a control valve, which adjusts the open degree of the control passage. The control passage is partially formed in the drive shaft. The movable body increases the inclination angle of the swash plate when the pressure of the control pressure chamber increases.

6 Claims, 6 Drawing Sheets

(51) Int. Cl.

| | |
|---|---|
| ***F04B 27/08*** | (2006.01) |
| ***F04B 27/12*** | (2006.01) |
| ***F04B 39/10*** | (2006.01) |
| ***F04B 39/12*** | (2006.01) |
| ***F04B 27/10*** | (2006.01) |
| ***F04B 39/00*** | (2006.01) |

(52) U.S. Cl.
CPC ..... *F04B 27/1054* (2013.01); *F04B 27/12* (2013.01); *F04B 39/0094* (2013.01); *F04B 39/10* (2013.01); *F04B 39/121* (2013.01); *F04B 39/123* (2013.01)

(58) Field of Classification Search
CPC .. F04B 39/121; F04B 39/123; F04B 27/1036; F04B 39/10
See application file for complete search history.

(56) References Cited

U.S. PATENT DOCUMENTS

| | | | | |
|---|---|---|---|---|
| 4,174,191 | A * | 11/1979 | Roberts | F04B 27/18 417/222.1 |
| 4,606,705 | A | 8/1986 | Parekh | |
| 4,884,952 | A | 12/1989 | Kanamaru et al. | |
| 4,946,350 | A | 8/1990 | Suzuki et al. | |
| 4,963,074 | A | 10/1990 | Sanuki et al. | |
| 5,032,060 | A | 7/1991 | Kobayashi et al. | |
| 5,186,475 | A | 2/1993 | Kawai et al. | |
| 5,259,736 | A | 11/1993 | Terauchi | |
| 5,370,503 | A | 12/1994 | Terauchi | |
| 5,636,973 | A | 6/1997 | Sonobe et al. | |
| 5,871,337 | A | 2/1999 | Fukanuma et al. | |
| 6,077,047 | A | 6/2000 | Nagai et al. | |
| 6,126,405 | A | 10/2000 | Kawaguchi et al. | |
| 6,135,722 | A | 10/2000 | Kawaguchi et al. | |
| 6,139,282 | A | 10/2000 | Ota et al. | |
| 6,149,398 | A | 11/2000 | Fukanuma et al. | |
| 6,158,968 | A | 12/2000 | Nakamura | |
| 6,227,812 | B1 | 5/2001 | Kawaguchi et al. | |
| 6,250,891 | B1 | 6/2001 | Kawaguchi et al. | |
| 6,379,120 | B1 | 4/2002 | Adaniya et al. | |
| 6,520,751 | B2 | 2/2003 | Fujita et al. | |
| 6,546,742 | B1 | 4/2003 | Ota et al. | |
| 6,848,262 | B2 | 2/2005 | Nosaka | |
| 6,957,604 | B1 | 10/2005 | Tiedemann et al. | |
| 7,530,797 | B2 | 5/2009 | Ito et al. | |
| 7,841,839 | B2 | 11/2010 | Inoue et al. | |
| 8,596,994 | B2 | 12/2013 | Taguchi | |
| 9,228,576 | B2 * | 1/2016 | Yamamoto | F04B 27/18 |
| 9,228,577 | B2 * | 1/2016 | Yamamoto | F04B 27/1054 |
| 9,309,874 | B2 * | 4/2016 | Yamamoto | F04B 27/1063 |
| 9,309,875 | B2 * | 4/2016 | Yamamoto | F04B 27/1804 |
| 9,316,217 | B2 * | 4/2016 | Yamamoto | F04B 27/1804 |
| 9,429,147 | B2 * | 8/2016 | Suzuki | F04B 1/295 |
| 9,506,459 | B2 * | 11/2016 | Ota | F04B 27/18 |
| 2002/0006339 | A1 | 1/2002 | Ota et al. | |
| 2003/0223887 | A1 | 12/2003 | Kawano et al. | |
| 2004/0062660 | A1 | 4/2004 | Kazahaya et al. | |
| 2009/0107327 | A1 | 4/2009 | Ota et al. | |
| 2014/0127042 | A1 | 5/2014 | Yamamoto et al. | |
| 2014/0127045 | A1 | 5/2014 | Yamamoto et al. | |
| 2014/0294613 | A1 * | 10/2014 | Suzuki | F04B 27/1804 417/222.2 |
| 2014/0294614 | A1 * | 10/2014 | Ota | F04B 27/1054 417/222.2 |
| 2015/0285234 | A1 | 10/2015 | Nakaima et al. | |

FOREIGN PATENT DOCUMENTS

| | | |
|---|---|---|
| EP | 2728186 | 5/2014 |
| EP | 2784316 | 10/2014 |
| JP | 52-131204 | 11/1977 |
| JP | 62-225782 | 10/1987 |
| JP | 62-247184 | 10/1987 |
| JP | 2-19665 | 1/1990 |
| JP | 5-172052 | 7/1993 |
| JP | 10-246181 | 9/1998 |
| JP | 4378190 | 12/2009 |
| KR | 10-1992-0021904 | 12/1992 |
| WO | 2014/069618 | 5/2014 |

OTHER PUBLICATIONS

Official Action for CN Appl. No. 201510134293.7 dated Aug. 17, 2016.
Extended European Search Report for EP App. No. 15160831.2 dated Nov. 13, 2015.
Extended European Search Report for EP App. No. 15160830.4 dated Nov. 13, 2015.
Extended European Search Report for EP App. No. 15160833.8 dated Nov. 13, 2015.
Search Report for EP Pat. App. No. 15160832.0 dated Nov. 13, 2015.
Official Action, along with English-language translation thereof, for CN Appl. No. 201510133583 dated Aug. 17, 2016.
U.S. Appl. No. 14/666,759 to Shinya Yamamoto et al., filed Mar. 24, 2015.
U.S. Appl. No. 14/666,860 to Shinya Yamamoto et al., filed Mar. 24, 2015.
U.S. Appl. No. 14/666,846 to Kazunari Honda et al., filed Mar. 24, 2015.
U.S. Appl. No. 14/666,688 to Shinya Yamamoto et al., filed Mar. 24, 2015.
U.S. Appl. No. 14/666,639 to Shinya Yamamoto et al., filed Mar. 24, 2015.
Official Action issued in U.S. Appl. No. 14/666,688 dated Jan. 27, 2017.
Official Action issued in U.S. Appl. No. 14/666,846 dated Feb. 6, 2017.
Official Action issued in U.S. Appl. No. 14/666,860 dated Feb. 9, 2017.
Official Action issued in U.S. Appl. No. 14/666,639 dated Apr. 6, 2017.
Official Action issued in U.S. Appl. No. 14/666,759 dated Apr. 18, 2017.

* cited by examiner

Up
Down
Front
Rear
O
1
3
3a
3b
3c
3d
3e
5
5a
5b
7
9
9a
9b
9c
11a
11b
13
13a
13b
13c
15c, 15d
17
17a
19
21
21a
21b
21c
21d
23
23a
23b
23c
23d
25
27a
27b
29a
29b
31
33
35a
35b
37a
37b
39
39a
39b
39c
41
41a
41b
41c
43
43a
43b
45
45a
45b
47a
47b
47c
49
49a
51a
51b
51c
130
130a
130b
130c
130d
131
M1
M2
M3

VARIABLE DISPLACEMENT SWASH PLATE COMPRESSOR

BACKGROUND OF THE INVENTION

The present invention relates to a variable displacement swash plate compressor.

Japanese Laid-Out Patent Publication No. 52-131204 describes a conventional variable displacement swash plate compressor (hereafter simply referred to as the compressor). The compressor has a housing including a suction chamber, a discharge chamber, a swash plate chamber, and a plurality of cylinder bores. A rotatable drive shaft is supported in the housing. A swash plate that is rotatable together with the drive shaft is arranged in the swash plate chamber. A link mechanism is located between the drive shaft and the swash plate to allow the inclination angle of the swash plate to change. The inclination angle refers to an angle relative to a direction orthogonal to the rotation axis of the drive shaft. Each cylinder bore accommodates a piston. The piston reciprocates in the cylinder bore and defines a compression chamber in the cylinder bore. A conversion mechanism coverts rotation of the swash plate to reciprocation of the piston in each cylinder bore. The stroke when the piston reciprocates is in accordance with the inclination angle of the swash plate. The inclination angle of the swash plate is changed by an actuator, which is controlled by a control mechanism.

The actuator is rotatable integrally with the drive shaft in the swash plate chamber. More specifically, the actuator includes a partitioning body fixed to the drive shaft. The partitioning body accommodates a movable body, which is movable relative to the partitioning body along the rotation axis. A control pressure chamber is defined between the partitioning body and the movable body to move the movable body with the pressure of the control pressure chamber. A communication passage, which is in communication with the control pressure chamber, extends through the drive shaft. A pressure control valve is arranged between the communication passage and the discharge chamber. The pressure control valve is configured to change the pressure of the control pressure chamber and move the movable body relative to the partitioning body along the rotation axis. The movable body includes a rear end that is in contact with a hinge ball. The hinge ball, which is located at the central portion of the swash plate, pivotally couples the swash plate to the drive shaft. A spring, which urges the hinge ball in the direction that increases the inclination angle of the swash plate, is arranged at the rear end of the hinge ball.

A link mechanism includes the hinge ball and an arm, which is located between the partitioning body and the swash plate. The spring urges the hinge ball from the rear and keeps the hinge ball in contact with the movable body. A first pin, which extends in a direction orthogonal to the rotation axis, is inserted to the front end of the arm. A second pin, which also extends in a direction orthogonal to the rotation axis, is inserted to the rear end of the arm. The swash plate is supported by the arm and the two pins to be pivotal to the partitioning body.

In the compressor, a pressure regulation valve opens to connect the discharge chamber and the pressure regulation chamber so that the pressure of the control pressure chamber becomes higher than that of the swash plate chamber. This moves the movable body toward the rear and pushes the hinge ball toward the rear against the urging force of the spring. Thus, the swash plate pivots to decrease its inclination angle and shorten the stroke of the pistons. This decreases the compressor displacement for each rotation of the drive shaft.

When the pressure regulation valve closes and disconnects the discharge chamber and the pressure regulation chamber, the pressure of the control pressure chamber becomes low and about the same as the swash plate chamber. This moves the movable body toward the front, and the hinge ball follows the movable body due to the urging force of the spring. Thus, the swash plate pivots in a direction opposite to when the inclination angle of the swash plate decreases. This increases the inclination angle of the swash plate and lengthens the stroke of the pistons.

In the conventional compressor described above, the actuator is adapted to decrease the pressure of the control pressure chamber and increase the inclination angle of the swash plate. Thus, it is difficult to promptly increase the compressor displacement.

SUMMARY OF THE INVENTION

It is an object of the present invention to provide a compressor that promptly increases the compressor displacement.

To achieve the above object, one aspect of the present invention is a variable displacement swash plate compressor including a housing, a drive shaft, a swash plate, a link mechanism, a plurality of pistons, a conversion mechanism, an actuator, and a control mechanism. The housing includes a suction chamber, a discharge chamber, a swash plate chamber, and a plurality of cylinder bores. The drive shaft is rotationally supported by the housing. The swash plate is rotatable together with the drive shaft in the swash plate chamber. The link mechanism is arranged between the drive shaft and the swash plate. The link mechanism allows for changes in an inclination angle of the swash plate relative to a direction orthogonal to a rotation axis of the drive shaft. The plurality of pistons is reciprocally accommodated in the cylinder bores respectively. The conversion mechanism reciprocates each piston in the cylinder bore with a stroke that is in accordance with the inclination angle of the swash plate when the swash plate rotates. The actuator is capable of changing the inclination angle of the swash plate. The control mechanism controls the actuator. The actuator is adapted to be rotatable integrally with the drive shaft. The actuator includes a partitioning body, which is loosely fitted to the drive shaft in the swash plate chamber, a movable body, which is coupled to the swash plate and movable relative to the partitioning body along the rotation axis, and a control pressure chamber, which is defined by the partitioning body and the movable body and moves the movable body by pressure of the control pressure chamber. At least one of the suction chamber and the swash plate chamber defines a low pressure chamber. The control mechanism includes a control passage and a control valve. The control passage connects the control pressure chamber, the low pressure chamber, and the discharge chamber. The control valve is capable of adjusting an open degree of the control passage. The control passage is at least partially formed in the drive shaft. The movable body is adapted to increase the inclination angle when the pressure of the control pressure chamber increases.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE EMBODIMENTS

One embodiment of the present invention will now be described with reference to FIGS. 1 to 4. Compressors of the first to fourth embodiments are each installed in a vehicle to form a refrigeration circuit of a vehicle air conditioner.

First Embodiment

Figure 1:
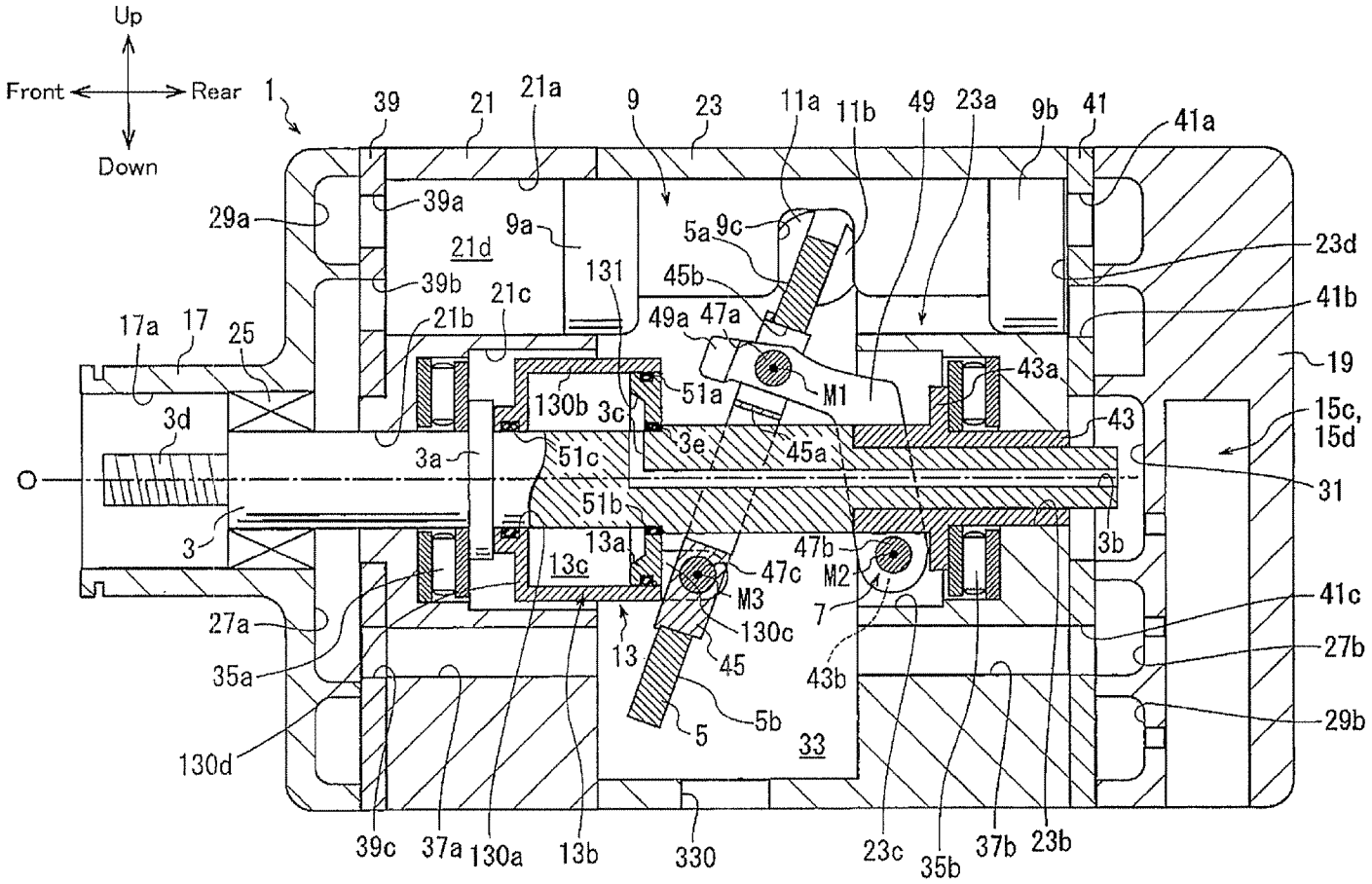
FIG. 1 is a cross-sectional view showing a compressor of first embodiment when the displacement is maximal.
Figure 2:
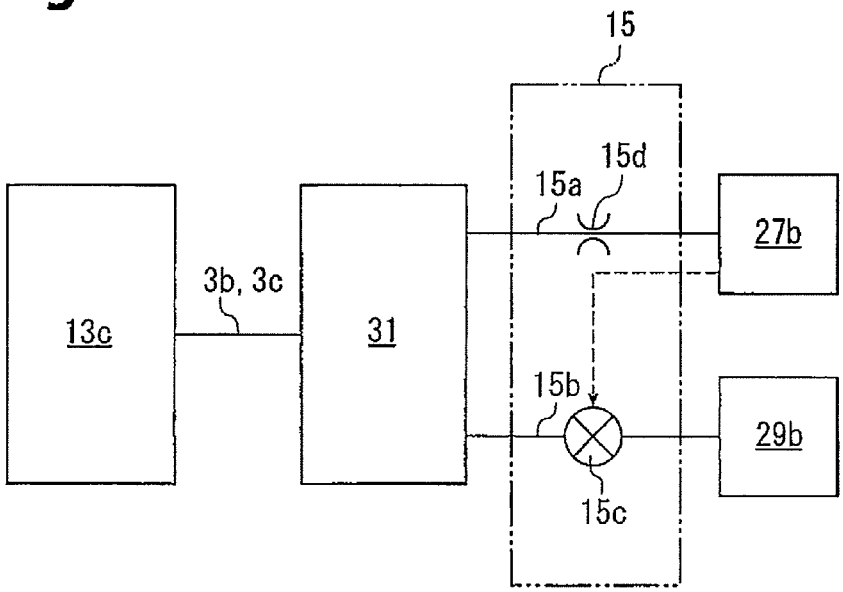
FIG. 2 is a schematic diagram showing a control mechanism in the compressor of first and third embodiments.
Figure 3:
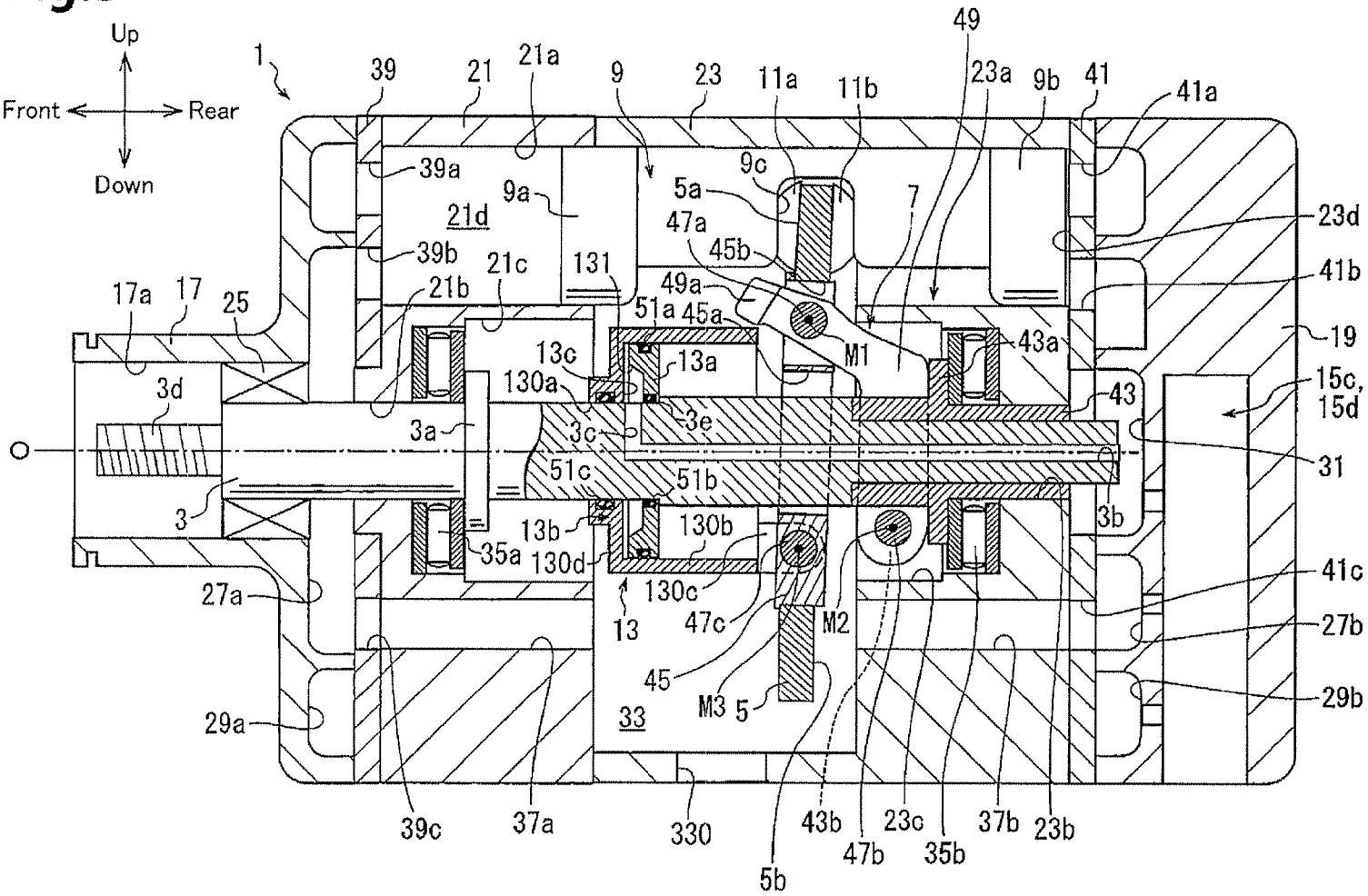
FIG. 3 is a cross-sectional view showing the compressor of first embodiment when the displacement is minimal.

Referring to FIGS. 1 and 3, a compressor of the first embodiment includes a housing 1, a drive shaft 3, a swash plate 5, a link mechanism 7, pistons 9, front and rear shoes 11*a* and 11*b*, an actuator 13, and a control mechanism 15, which is shown in FIG. 2. Each piston 9 is provided with a pair of the shoes 11*a* and 11*b*.

As shown in FIG. 1, the housing 1 includes a front housing member 17, which is located at the front of the compressor, a rear housing member 19, which is located at the rear of the compressor, and first and second cylinder blocks 21 and 23, which are located between the front housing member 17 and the rear housing member 19.

The front housing member 17 includes a boss 17*a*, which projects toward the front. A sealing device 25 is arranged in the boss 17*a* around the drive shaft 3. Further, the front housing member 17 includes a first suction chamber 27*a* and a first discharge chamber 29*a*. The first suction chamber 27*a* is located in a radially inner portion of the front housing member 17, and the first discharge chamber 29*a* is located in a radially outer portion of the front housing member 17.

The rear housing member 19 includes the control mechanism 15. The rear housing member 19 includes a second suction chamber 27*b*, a second discharge chamber 29*b*, and a pressure regulation chamber 31. The second suction chamber 27*b* is located in a radially inner portion of the rear housing member 19, and the second discharge chamber 29*b* is located in a radially outer portion of the rear housing member 19. The pressure regulation chamber 31 is located in a radially central portion of the rear housing member 19. A discharge passage (not shown) connects the first discharge chamber 29*a* and the second discharge chamber 29*b*. The discharge passage includes a discharge port, which is in communication with the outer side of the compressor.

A swash plate chamber 33 is defined in the first cylinder block 21 and the second cylinder block 23. The swash plate chamber 33 is located in a central portion of the housing 1.

The first cylinder block 21 includes first cylinder bores 21*a*, which are arranged at equal angular intervals in the circumferential direction and which extend parallel to one another. Further, the first cylinder block 21 includes a first shaft bore 21*b*. The drive shaft 3 extends through the first shaft bore 21*b*. The first cylinder block 21 also includes a first recess 21*c*, which is located at the rear side of the first shaft bore 21*b*. The first recess 21*c* is in communication with the first shaft bore 21*b* and coaxial with the first shaft bore 21*b*. Further, the first recess 21*c* is in communication with the swash plate chamber 33 and includes a stepped wall surface. A first thrust bearing 35*a* is arranged in a front portion of the first recess 21*c*. The first cylinder block 21 includes a first suction passage 37*a* that communicates the swash plate chamber 33 with the first suction chamber 27*a*.

In the same manner as the first cylinder block 21, the second cylinder block 23 includes second cylinder bores 23*a*. Further, the second cylinder block 23 includes a second shaft bore 23*b*. The drive shaft 3 extends through the second shaft bore 23*b*. The second shaft bore 23*b* is in communication with the pressure regulation chamber 31. The second cylinder block 23 also includes a second recess 23*c*, which is located at the front side of the second shaft bore 23*b*. The second recess 23*c* is in communication with the second shaft bore 23*b* and coaxial with the second shaft bore 23*b*. Further, the second recess 23*c* is in communication with the swash plate chamber 33 and includes a stepped wall surface. A second thrust bearing 35*b* is arranged in a rear portion of the second recess 23*c*. The second cylinder block 23 includes a second suction passage 37*b* that communicates the swash plate chamber 33 with the second suction chamber 27*b*.

The swash plate chamber 33 is connected to an evaporator (not shown) via a suction port 330 formed in the second cylinder block 23.

A first valve plate 39 is arranged between the front housing member 17 and the first cylinder block 21. The first valve plate 39 includes a suction port 39*b* and a discharge port 39*a* for each first cylinder bore 21*a*. A suction valve mechanism (not shown) is provided for each suction port 39*b*. Each suction port 39*b* communicates the corresponding first cylinder bore 21*a* with the first suction chamber 27*a*. A discharge valve mechanism (not shown) is provided for each discharge port 39*a*. Each discharge port 39*a* communicates the corresponding first cylinder bore 21*a* with the first discharge chamber 29*a*. The first valve plate 39 also includes a communication hole 39*c*. The communication hole 39*c* communicates the first suction chamber 27*a* with the swash plate chamber 33 through the first suction passage 37*a*.

A second valve plate 41 is arranged between the rear housing member 19 and the second cylinder block 23. In the same manner as the first valve plate 39, the second valve plate 41 includes a suction port 41*b* and a discharge port 41*a* for each second cylinder bore 23*a*. A suction valve mechanism (not shown) is provided for each suction port 41*b*. Each suction port 41*b* communicates the corresponding second cylinder bore 23*a* with the second suction chamber 27*b*. A discharge valve mechanism (not shown) is provided for each discharge port 41*a*. Each discharge port 41*a* communicates the corresponding second cylinder bore 23*a* with the second discharge chamber 29*b*. The second valve plate 41 also includes a communication hole 41*c*. The communication hole 41*c* communicates the second suction chamber 27*b* with the swash plate chamber 33 through the second suction passage 37*b*.

The first and second suction chambers 27*a* and 27*b* and the swash plate chamber 33 are in communication with one another through the first and second suction passages 37*a* and 37*b*. Thus, the first and second suction chambers 27*a* and 27*b* and the swash plate chamber 33 have substantially the same pressure. More accurately, the pressure of the swash plate chamber 33 is slightly higher than the pressure of the first and second suction chambers 27*a* and 27*b* due to the effect of blow-by gas. Refrigerant gas from the evaporator flows into the swash plate chamber 33 through the suction port 330. Thus, the pressure of each of the swash plate chamber 33 and the first and second suction chambers 27*a* and 27*b* is lower than the pressure of each of the first and second discharge chambers 29*a* and 29*b*. In this manner, the swash plate chamber 33 and the first and second suction chambers 27*a* and 27*b* define a low pressure chamber.

The swash plate 5, the actuator 13, and a flange 3*a* are arranged on the drive shaft 3. The drive shaft 3 is inserted through the boss 17*a* toward the rear and inserted to the first and second shaft bores 21*b* and 23*b* in the first and second cylinder blocks 21 and 23. The front end of the drive shaft 3 is located in the boss 17*a*, and the rear end is located in the pressure regulation chamber 31. The first and second shaft bores 21*b* and 23*b* support the drive shaft 3 in the housing 1 so that the drive shaft 3 is rotatable about the rotation axis O. The swash plate 5, the actuator 13, and the flange 3*a* are each located in the swash plate chamber 33. The flange 3*a* is located between the first thrust bearing 35*a* and the actuator 13, more specifically, between the first thrust bearing 35*a* and a movable body 13*b*. The flange 3*a* restricts contact of the first thrust bearing 35*a* and the movable body 13*b*. Radial bearings may be arranged between the drive shaft 3 and the walls of the first and second shaft bores 21*b* and 23*b*.

A support member 43 is fitted to the rear portion of the drive shaft 3. The support member 43 serves as a second member. The support member 43 includes a flange 43*a*, which is in contact with the second thrust bearing 35*b*, and a coupling portion 43*b*, which receives a second pin 47*b*. The drive shaft 3 includes an axial passage 3*b* and a radial passage 3*c*. The axial passage 3*b* extends through the drive shaft along the rotation axis O toward the front from the rear end of the drive shaft 3. The radial passage 3*c* extends from the front end of the axial passage 3*b* in the radial direction and opens in the outer surface of the drive shaft 3. The axial passage 3*b* and the radial passage 3*c* define a communication passage of the present invention. The rear end of the axial passage 3*b* is connected to the pressure regulation chamber 31, or the low pressure chamber. The radial passage 3*c* is connected to a control pressure chamber 13*c*. Further, the drive shaft 3 includes a step 3*e*.

The swash plate 5 is an annular plate and includes a front surface 5*a* and a rear surface 5*b*. The front surface 5*a* of the swash plate 5 faces the front side of the compressor in the swash plate chamber 33. The rear surface 5*b* of the swash plate 5 faces the rear side of the compressor in the swash plate chamber 33. The swash plate 5 is fixed to a ring plate 45. The ring plate 45, which serves as a first member, is an annular plate. An insertion hole 45*a* extends through the center of the ring plate 45. The drive shaft 3 is inserted to the insertion hole 45*a* to couple the swash plate 5 to the drive shaft 3 in the swash plate chamber 33 near the cylinder bores 23*a*, that is, at the rear of the swash plate chamber 33.

The link mechanism 7 includes a lug arm 49. The lug arm 49 is arranged at the rear side of the swash plate 5 in the swash plate chamber 33 and located between the swash plate 5 and the support member 43. The lug arm 49 is generally L-shaped. The lug arm 49 contacts the flange 43*a* of the support member 43 when the swash plate 5 is inclined relative to a direction orthogonal to the rotation axis O at the minimum angle. In the compressor, the lug arm 49 allows the swash plate 5 to be maintained at the minimum inclination angle. The distal end of the lug arm 49 includes a weight 49*a*. The weight 49*a* extends over one half of the circumference of the actuator 13. The weight 49*a* may be designed to have a suitable shape.

A first pin 47*a* couples the distal end of the lug arm 49 to a top region of the ring plate 45. Thus, the distal end of the lug arm 49 is supported by the ring plate 45, or the swash plate 5, so that the lug arm 49 is pivotal about the axis of the first pin 47*a*, namely, a first pivot axis M1. The first pivot axis M1 extends in a direction perpendicular to the rotation axis O of the drive shaft 3.

A second pin 47*b* couples a basal end of the lug arm 49 to the support member 43. Thus, the basal end of the lug arm 49 is supported by the support member 43, or the drive shaft 3, so that the lug arm 49 is pivotal about the axis of the second pin 47*b*, namely, a second pivot axis M2. The second pivot axis M2 extends parallel to the first pivot axis M1. The lug arm 49 and the first and second pins 47*a* and 47*b* correspond to the link mechanism 7 of the present invention.

In the compressor, the link mechanism 7 couples the swash plate 5 and the drive shaft 3 so that the swash plate 5 rotates together with the drive shaft 3. The lug arm 49 has the distal end and the basal end that are respectively pivotal about the first pivot axis M1 and the second pivot axis M2 so that inclination angle of the swash plate 5 is changed.

The weight 49*a* extends along the distal end of the lug arm 49, that is, on the side opposite to the second pivot axis M2 with respect to the first pivot axis M1. The lug arm 49 is supported by the first pin 47*a* on the ring plate 45 so that the weight 49*a* is inserted through a groove 45*b* in the ring plate 45 and is located at the front side of the ring plate 45, that is, the front side of the swash plate 5. Rotation of the swash plate 5 around the rotation axis O generates centrifugal force that acts on the weight 49*a* at the front side of the swash plate 5.

Each piston 9 includes a front end that defines a first piston head 9*a* and a rear end that defines a second piston head 9*b*. The first piston head 9*a* is reciprocally accommodated in the corresponding first cylinder bore 21*a* defining a first compression chamber 21*d*. The second piston head 9*b* is reciprocally accommodated in the corresponding second cylinder bore 23*a* defining a second compression chamber 23*d*. Each piston 9 includes a recess 9*c*, which accommodates the semispherical shoes 11*a* and 11*b*. The shoes 11*a* and 11*b* convert the rotation of the swash plate 5 to the reciprocation of the piston 9. The shoes 11*a* and 11*b* correspond to a conversion mechanism of the present invention. In this manner, the first and second piston heads 9*a* and 9*b* are reciprocal in the first and second cylinder bores 21*a* and 23*a* with a stroke that is in accordance with the inclination angle of the swash plate 5.

The actuator 13 is located in front of the swash plate 5 in the swash plate chamber 33 and is movable into the first recess 21*c*. The actuator 13 includes a partitioning body 13*a* and a movable body 13*b*.

The partitioning body 13*a* is disk-shaped and loosely fitted to the drive shaft 3 in the swash plate chamber 33. An O-ring 51*a* is arranged on the outer circumferential surface of the partitioning body 13*a*, and an O-ring 51*b* is arranged on the inner circumferential surface of the partitioning body 13*a*. The front surface of the partitioning body 13*a* includes a sloped surface 131. The sloped surface 131 is formed so that its diameter increases from the rear toward the front and from the center of the partitioning body 13*a* toward the outer circumferential surface of the partitioning body 13*a*. Thus, the inner diameter of the front surface of the partitioning body 13*a* increases toward the surface where the movable body 13*b* moves along the partitioning body 13*a*. In this manner, the inner surface of the partitioning body 13*a* includes at least a portion having a diameter that increases toward the surface where the movable body 13*b* moves along the partitioning body 13*a*.

The movable body 13*b* includes an insertion hole 130*a*, to which the drive shaft 3 is inserted, a flange 130*d*, which extends around the drive shaft 3 and away from the rotation axis O in the radial direction, a main body portion 130*b*, which is continuous with the flange 130*d* and extends from the front of the movable body 13*b* toward the rear, and a coupling portion 130*c*, which is formed on the rear end of the main body portion 130*b*. An O-ring 51*c* is arranged in the insertion hole 130*a*. The insertion hole 130*a*, the flange 130*d*, and the main body portion 130*b* form the movable body 13*b* that is cylindrical and has a closed end. The main body portion 130*b* corresponds to the outer wall of the present invention.

The movable body 13*b* is thinner than the partitioning body 13*a*. Although the outer diameter of the movable body 13*b* is set so that the movable body 13*b* does not contact the wall surface of the first recess 21*c*, the outer diameter is substantially the same as the diameter of the first recess 21*c*. The movable body 13*b* is located between the first thrust bearing 35*a* and the swash plate 5.

The drive shaft 3 is inserted into the main body portion 130*b* of the movable body 13*b* and through the insertion hole 130*a*. The partitioning body 13*a* is arranged in a movable manner in the main body portion 130*b*. Thus, the partitioning body 13*a* is surrounded by the main body portion 130*b*. In this manner, the movable body 13*b* is rotatable together with the drive shaft 3 and movable along the rotation axis O of the drive shaft 3 in the swash plate chamber 33. By inserting the drive shaft 3 into the main body portion 130*b*, the movable body 13*b* and the link mechanism 7 are located at opposite sides of the swash plate 5. The O-ring 51*c* is arranged in the insertion hole 130*a*. In this manner, the drive shaft 3 extends through the actuator 13, and the actuator 13 is rotatable integrally with the drive shaft 3 about the rotation axis O.

A third pin 47*c* couples a bottom region of the ring plate 45 to the coupling portion 130*c* of the movable body 13*b*. Thus, the bottom portion of the ring plate 45, or the swash plate 5, is supported by the movable body 13*b* so as to be pivotal about the axis of the third pin 47*c*, namely, an action axis M3. The third pin 47*c*, or the action axis M3, which is where the coupling portion 30*c* is coupled to the bottom region of the ring plate 45, serves as an action point M3, which changes the inclination angle of the swash plate 5 relative to the rotation axis O of the drive shaft 3. To facilitate the description hereafter, reference character M3 is added to the action axis and the action point. The action axis M3 extends parallel to the first and second pivot axes M1 and M2. In this manner, the movable body 13*b* is coupled to the swash plate 5. The movable body 13*b* contacts the flange 3*a* when the swash plate 5 is inclined at the maximum angle. In the compressor, the movable body 13*b* allows the swash plate 5 to be maintained at the maximum inclination angle.

The control pressure chamber 13*c* is defined between the partitioning body 13*a* and the movable body 13*b*. The control pressure chamber 13*c* is surrounded and covered by the main body portion 130*b*. The radial passage 3*c* opens to the control pressure chamber 13*c*. The control pressure chamber 13*c* is in communication with the pressure regulation chamber 31 through the radial passage 3*c* and the axial passage 3*b*.

As shown in FIG. 2, the control mechanism 15 includes a bleed passage 15*a*, a gas supplying passage 15*b*, a control valve 15*c*, and an orifice 15*d*.

The bleed passage 15*a* is connected to the pressure regulation chamber 31 and the second suction chamber 27*b*. The pressure regulation chamber 31 is in communication with the control pressure chamber 13*c* through the axial passage 3*b* and the radial passage 3*c*. Thus, the control pressure chamber 13*c* and the second suction chamber 27*b* are in communication with each other through the bleed passage 15*a*. The bleed passage 15*a* includes the orifice 15*d*.

The gas supplying passage 15*b* is connected to the pressure regulation chamber 31 and the second discharge chamber 29*b*. Thus, in the same manner as the bleed passage 15*a*, the control pressure chamber 13*c* and the second discharge chamber 29*b* are in communication with each other through the axial passage 3*b* and the radial passage 3*c*. In this manner, the axial passage 3*b* and the radial passage 3*c* form portions of the bleed passage 15*a* and the gas supplying passage 15*b*, which serve as the control passage.

The control valve 15*c* is arranged in the gas supplying passage 15*b*. The control valve 15*c* is operative to adjust the open degree of the gas supplying passage 15*b* based on the pressure of the second suction chamber 27*b*. More specifically, when the thermal load on the evaporator decreases and the pressure of the second suction chamber 27*b* decreases, the control valve 15*c* regulates its open degree to decrease the open degree of the gas supplying passage 15*b*. A known valve may be used as the control valve 15*c*.

The distal end of the drive shaft portion 3*d*. The threaded portion 3*d* couples the drive shaft 3 to a pulley or an electromagnetic clutch (neither shown). A belt (not shown), which is driven by a vehicle engine, runs along the pulley or a pulley of the electromagnetic clutch.

A pipe leading to the evaporator is connected to the suction port 330. A pipe leading to a condenser is connected to a discharge port (none shown). The compressor, the evaporator, an expansion valve, the condenser, and the like form the refrigeration circuit of the vehicle air conditioner.

In the compressor, the rotation of the drive shaft 3 rotates the swash plate 5 and reciprocates each piston 9 in the corresponding first and second cylinder bores 21*a* and 23*a*. Thus, the volumes of the first and second compression chambers 21*d* and 23*d* change in accordance with the piston stroke. This draws refrigerant gas into the swash plate chamber 33 through the suction port 330 from the evaporator. The refrigerant gas flows through the first and second suction chambers 27*a* and 27*b* and is compressed in the first and second compression chambers 21*d* and 23*d*, which then discharge the refrigerant gas into the first and second discharge chambers 29*a* and 29*b*. The refrigerant gas in the first and second discharge chambers 29*a* and 29*b* is discharged out of the discharge port and sent to the condenser.

During operation of the compressor, centrifugal force, which acts to decrease the inclination angle of the swash plate, and compression reaction, which acts to decrease the inclination angle of the swash plate 5 through the pistons 9, are applied to the rotation members, which include the swash plate 5, the ring plate 45, the lug arm 49, and the first pin 47*a*. The compressor displacement may be controlled by changing the inclination angle of the swash plate 5 thereby lengthening or shortening the stroke of the pistons 9.

More specifically, when the thermal load of the evaporator is small and the pressure of the second suction chamber 27*b* is low, the control valve 15*c* of the control mechanism 15 shown in FIG. 2 decreases the open degree of the gas supplying passage 15*b*. Thus, the pressure of the control pressure chamber 13*c* becomes substantially equal to the pressure of the second suction chamber 27*b*. Here, the centrifugal force and the compression reaction acting on the rotation members move the movable body 13*b* toward the rear. This contracts the control pressure chamber 13*c* and decreases the inclination angle of the swash plate 5.

Referring to FIG. 3, when the pressure of the control pressure chamber 13*c* becomes low and decreases the difference between the pressure of the control pressure chamber 13*c* and the pressure of the swash plate chamber 33, the centrifugal force and the compression reaction acting on the rotation members move the movable body 13*b* in the swash plate chamber 33 toward the rear along the rotation axis O of the drive shaft 3. This pivots the bottom region of the ring plate 45, or the bottom region of the swash plate 5, with the coupling portion 130*c* in the counterclockwise direction about the action axis M3. Further, one end of the lug arm 49 is pivoted in the clockwise direction about the first pivot axis M1, and the other end of the lug arm 49 is pivoted in the clockwise direction about the second pivot axis M2. Thus, the lug arm 49 moves toward the flange 43*a* of the support member 43. This pivots the swash plate 5 using the action axis M3, which is located at the bottom region, as the action point M3 and the first pivot axis M1, which is located at the top region, as a fulcrum point M1. To facilitate the description hereafter, the reference character M1 indicates both of the pivot axis and the fulcrum point. In this manner, the inclination angle of the swash plate 5 relative to the direction orthogonal to the rotation axis O of the drive shaft decreases and shortens the stroke of the pistons 9 thereby decreasing the compressor displacement for each rotation of the drive shaft 3. The inclination angle of the swash plate 5 in FIG. 3 is the minimum inclination angle of the compressor.

In the compressor, the centrifugal force acting on the weight 49*a* is applied to the swash plate 5. Thus, in the compressor, the swash plate 5 easily moves in the direction that decreases the inclination angle of the swash plate 5. Further, when the movable body 13*b* moves toward the rear along the rotation axis O of the drive shaft 3, the rear end of the movable body 13*b* is arranged at the inner side of the weight 49*a*. As a result, in the compressor, when the inclination angle of the swash plate 5 decreases, the weight 49*a* covers about one half of the rear end of the movable body 13*b*.

When a large thermal load is applied to the evaporator and the pressure of the second suction chamber 27*b* is high, the control valve 15*c* of the control mechanism shown in FIG. 2 increases the open degree of the gas supplying passage 15*b*. Thus, the pressure of the control pressure chamber 13*c* becomes substantially equal to the pressure of the second discharge chamber 29*b*. As a result, the movable body 13*b* of the actuator 13 moves toward the front against the centrifugal force and the compression reaction acting on the rotation members. This expands the control pressure chamber 13*c* and increases the inclination angle of the swash plate 5.

Referring to FIG. 1, when the pressure of the control pressure chamber 13*c* becomes higher than the pressure of the swash plate chamber 33, the movable body 13*b* moves toward the front along the rotation axis O of the drive shaft 3 in the swash plate chamber 33. This pulls the bottom region of the swash plate 5 with the coupling portion 130*c* toward the front at the action axis and pivots the bottom region of the swash plate 5 in the clockwise direction about the action axis M3. Further, one end of the lug arm 49 is pivoted in the counterclockwise direction about the first pivot axis M1, and the other end of the lug arm 49 is pivoted in the counterclockwise direction about the second pivot axis M2. Thus, the lug arm 49 moves away from the flange 43*a* of the support member 43. This pivots the swash plate 5 in a direction opposite to when decreasing the inclination angle using the action axis M3 as the action point M3 and the first pivot axis M1 as the fulcrum point M1. In this manner, the inclination angle of the swash plate 5 relative to the direction orthogonal to the rotation axis O of the drive shaft increases and lengthens the stroke of the pistons 9 thereby increasing the compressor displacement for each rotation of the drive shaft 3. The inclination angle of the swash plate 5 in FIG. 1 is the maximum inclination angle of the compressor.

In this manner, the control valve 15*c* supplies the control pressure chamber 13*c* with the pressure of the second discharge chamber 29*b* through the gas supplying passage 15*b*, the pressure regulation chamber 31, the axial passage 3*b*, and the radial passage 3*c* so that the pressure of the control pressure chamber 13*c* becomes higher than the pressure of the swash plate chamber 33. Thus, the movable body 13*b* promptly increases the inclination angle of the swash plate 5 in the compressor.

In the compressor, the movable body 13*b* includes the flange 130*d* and the main body portion 130*b*, which is continuous with the flange 130*d*. The main body portion 130*b* is formed integrally with the flange 130*d* at the outer rim of the flange 130*d* and extends along the rotation axis O. Further, the main body portion 130*b* is movable toward the front and rear along the rotation axis O relative to the outer rim of the partitioning body 13*a*. When the main body portion 130*b* moves along the rotation axis O of the movable body 13*b*, the movable body 13*b* applies a pulling force or a pushing force to the swash plate 5. Thus, the movable body 13*b* increases the inclination angle of the swash plate with the pulling force that pulls the bottom region of the swash plate 5 or decrease the inclination angle of the swash plate 5 with the pushing force that pushes the bottom region of the swash plate 5.

The coupling portion 130*c* of the main body portion 130*b* includes the action point M3 where the swash plate 5 is coupled. This allows the pulling force or the pushing force to be directly transmitted to the swash plate 5 when changing the inclination angle of the swash plate 5. Thus, in the compressor, the actuator 13 easily changes the inclination angle of the swash plate 5.

The front surface of the partitioning body 13*a* includes the sloped surface 131. The sloped surface 131 is formed so that its diameter increases at frontward positions from the center of the partitioning body 13*a* toward the outer circumferential surface of the partitioning body 13*a*

In the compressor, lubrication oil is suspended in the refrigerant gas drawn into the control pressure chamber 13*c*. Thus, when the partitioning body 13*a* and the movable body 13*b* rotate together with the drive shaft 3, the generated centrifugal force disperses lubrication oil to the partitioning body 13*a* and the inner circumferential surface of the movable body 13*b*. The sloped surface 131, the diameter of which is increased toward the moving surfaces, smoothly guides the dispersed lubrication oil to the moving surfaces of the partitioning body 13*a* and the movable body 13*b*. This sufficiently lubricates the moving surfaces of the partitioning body 13*a* and the movable body 13*b* in the compressor. The compressor also limits clogging of the radial passage 3*c* that would be caused by the lubrication oil. Thus, the refrigerant gas is circulated in the preferred manner between the pressure regulation chamber 31 and the control pressure chamber 13*c*.

The partitioning body 13*a* is loosely fitted to the drive shaft 3 in the compressor. Thus, in the compressor, the movable body 13*b* is smoothly moved relative to the partitioning body 13*a*. This allows the movable body 13*b* to be moved in a preferred manner along the rotation axis O.

Accordingly, the compressor displacement is promptly controlled when decreasing the compression displacement in addition to when increasing the compression displacement.

The axial passage 3*b* and the radial passage 3*c* extend through the drive shaft 3 in the compressor. Thus, in the compressor, the centrifugal force generated when the partitioning body 13*a* and the movable body 13*b* rotate together with the drive shaft 3 disperses the lubrication oil, which is suspended in the refrigerant gas drawn into the control pressure chamber 13*c*, in the control pressure chamber 13*c* from the radial passage 3*c* toward the radially outer side of the drive shaft 3. This reduces residual lubrication oil near the radial passage and limits clogging of the axial passage 3*b* and the radial passage 3*c* that would be caused by the lubrication oil. Thus, the refrigerant gas is circulated in the preferred manner between the pressure regulation chamber 31 and the control pressure chamber 13*c*. Further, in the compressor, the axial passage 3*b* and the radial passage 3*c* form the communication passage. This simplifies the structure of the communication passage. In the compressor, the communication passage may be easily formed in the drive shaft 3. Thus, the size of the compressor is reduced.

Further, in the compressor, the control valve 15*c* of the control mechanism 15 opens to supply the pressure regulation chamber 31 with pressure from the second discharge chamber 29*b*. Thus, the compressor may be shifted in the optimal manner from a condition in which the compression displacement is decreased to a condition in which the compression displacement is increased.

When the pressure of the second suction chamber 27*b* decreases, the pressure of the control valve 15*c* decreases the pressure of the pressure regulation chamber 31. Thus, when a refrigerant circuit including the compressor is installed in a vehicle, the passenger compartment is air-conditioned in accordance with the cooling requirements.

In the compressor, the swash plate chamber 33 is used as a passage for the refrigerant gas to the first and second suction chambers 27*a* and 27*b*. This produces a muffler effect that reduces the suction pulsation of the refrigerant gas and reduces the noise of the compressor.

The control valve 15*c* is configured to decrease the pressure of the control pressure chamber 13*c* under a low thermal load. In this case, when the thermal load falls, the inclination angle of the swash plate 5 may be decreased to decrease the compression displacement for each rotation of the drive shaft 3. In this manner, the compressor performs displacement control in accordance with the thermal load.

Second Embodiment

Figure 4:
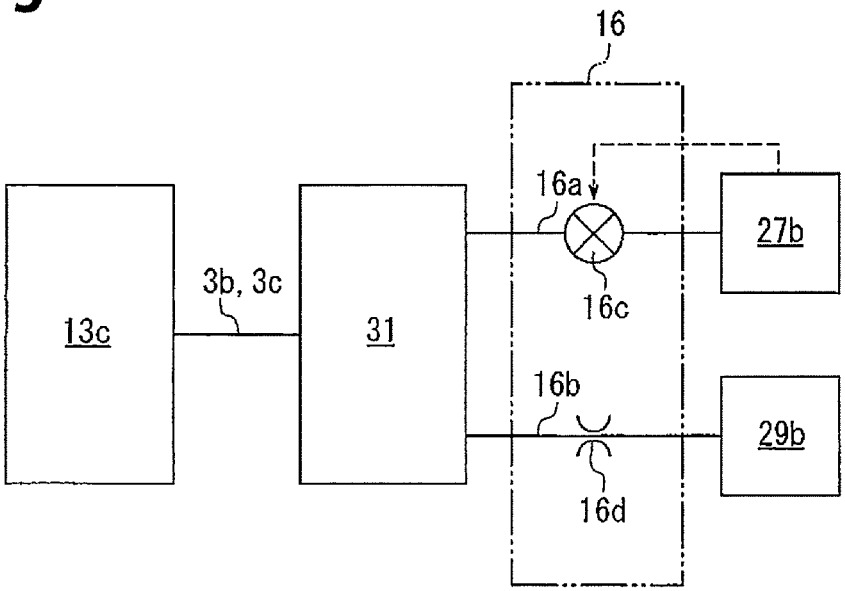
FIG. 4 is a schematic diagram showing a control mechanism in a compressor of second and fourth embodiments.

A compressor of the second embodiment includes a control mechanism 16 shown in FIG. 4 instead of the control mechanism 15 used in the compressor of the first embodiment. The control mechanism 16 includes a bleed passage 16*a*, a gas supplying passage 16*b*, a control valve 16*c*, and an orifice 16*d*. The bleed passage 16*a* and the gas supplying passage 16*b* form a control passage.

The bleed passage 16*a* is connected to the pressure regulation chamber 31 and the second suction chamber 27*b*. Thus, the control pressure chamber 13*c* and the second suction chamber 27*b* are in communication with each other through the bleed passage 16*a*. The gas supplying passage 16*b* is connected to the pressure regulation chamber 31 and the second discharge chamber 29*b*. Thus, the control pressure chamber 13*c* and the pressure regulation chamber 31 are in communication with the second discharge chamber 29*b* through the gas supplying passage 16*b*. The gas supplying passage 16*b* includes the orifice 16*d*.

The control valve 16*c* is arranged in the bleed passage 16*a*. The control valve 16*c* is operative to adjust the open degree of the bleed passage 16*a* based on the pressure of the second suction chamber 27*b*. In the same manner as the control valve 15*c*, a known valve may be used as the control valve 16*c*. Further, the axial passage 3*b* and the radial passage 3*c* form portions of the bleed passage 16*a* and the gas supplying passage 16*b*. Other portions of the compressor have the same structure as the compressor of the first embodiment. Same reference numerals are given to those components that are the same as the corresponding components of the first embodiment. Such components will not be described in detail.

In the control mechanism 16 of the compressor, when the control valve 16*c* decreases the open degree of the bleed passage 16*a*, the pressure of the control pressure chamber 13*c* becomes substantially equal to the pressure of the second discharge chamber 29*b*. Thus, the movable body 13*b* of the actuator 13 moves toward the front against the centrifugal force and the compression reaction acting on the rotation members. This expands the control pressure chamber 13*c* and increases the inclination angle of the swash plate 5.

As a result, in the same manner as the compressor of the first embodiment, the inclination angle of the swash plate 5 increases in the compressor and lengthens the stroke of the pistons 9. This increases the compressor displacement for each rotation of the drive shaft 3 (refer to FIG. 1).

As shown in FIG. 4, when the control valve 16*c* increases the open degree of the bleed passage 16*a*, the pressure of the control pressure chamber 13*c* becomes substantially equal to the pressure of the second suction chamber 27*b*. Thus, the centrifugal force and the compression reaction acting on the rotation members move the movable body 13*b* toward the rear. This contracts the control pressure chamber 13*c* and decreases the inclination angle of the swash plate 5.

As a result, the inclination angle of the swash plate 5 decreases in the compressor and shortens the stroke of the pistons 9. This decreases the compressor displacement for each rotation of the drive shaft 3 (refer to FIG. 3).

In the control mechanism 16 of the compressor, the control valve 16*c* allows for adjustment of the open degree of the bleed passage 16*a*. Thus, in the compressor, the low pressure of the second suction chamber 27*b* gradually decreases the pressure of the control pressure chamber 13*c* to a low value so that a suitable driving feel of the vehicle is maintained. Otherwise, the operation of the compressor is the same as the compressor of the first embodiment.

Third Embodiment

Figure 5:
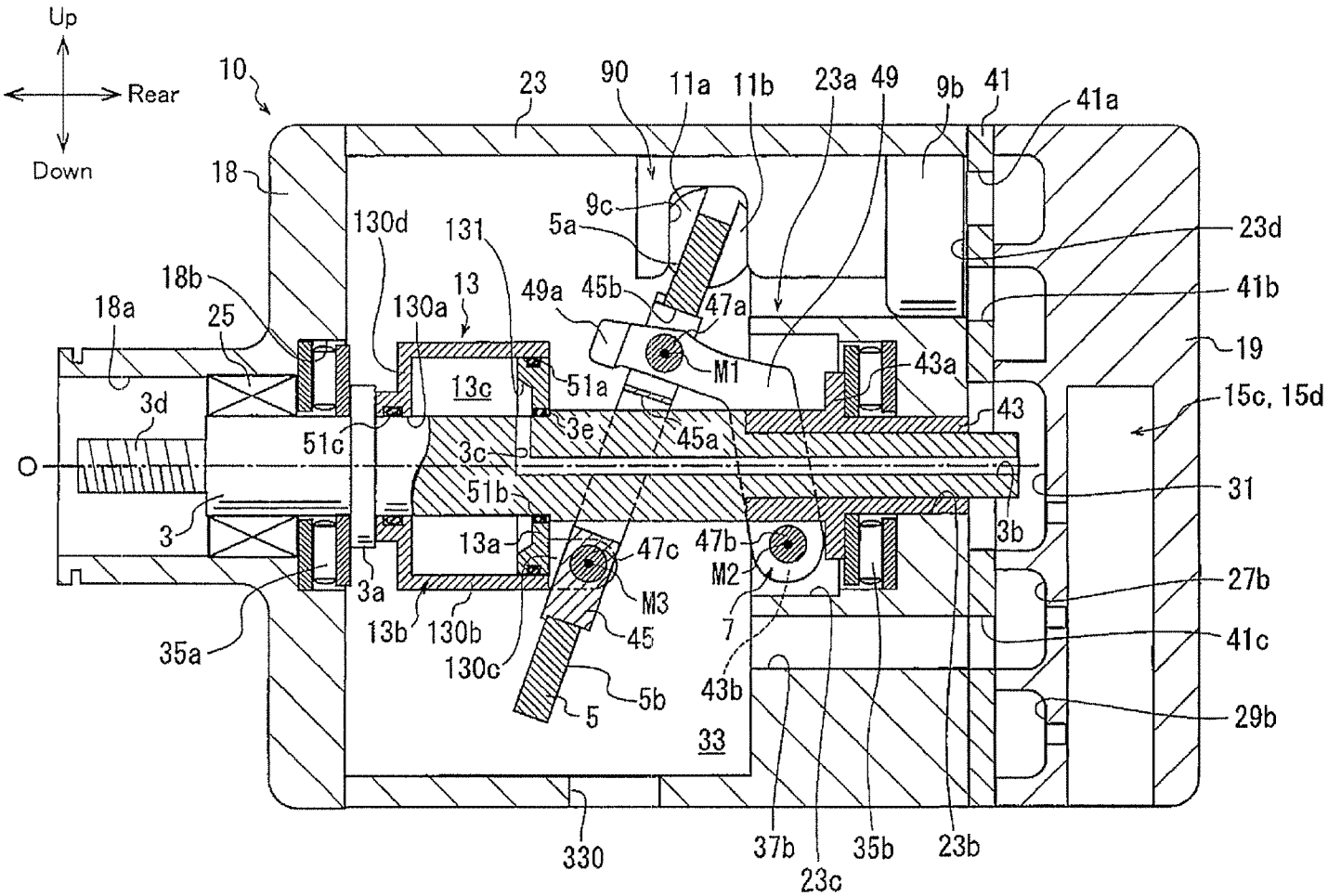
FIG. 5 is a cross-sectional view showing the compressor of third embodiment when the displacement is maximal.
Figure 6:
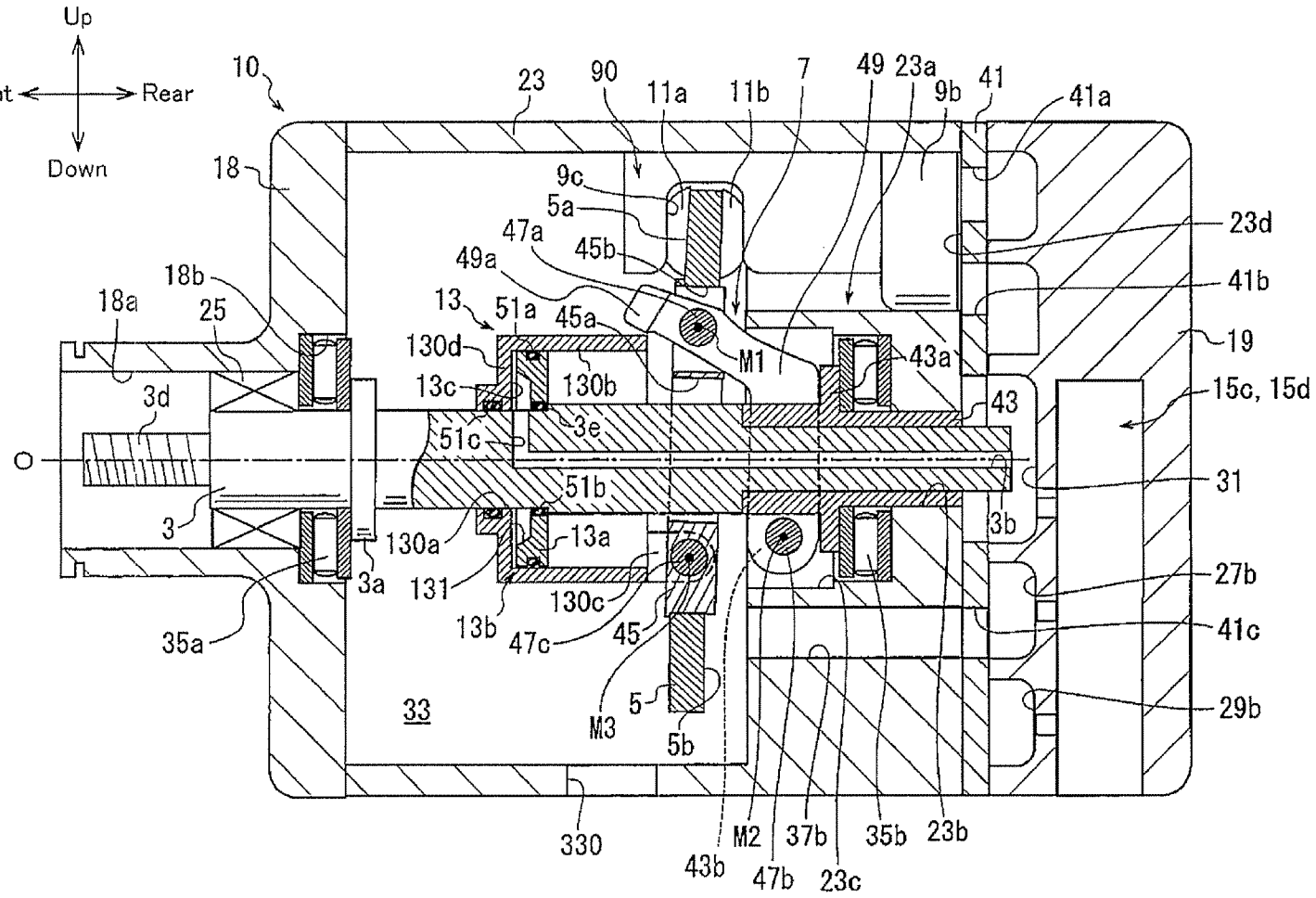
FIG. 6 is a cross-sectional view showing the compressor of third embodiment when the displacement is minimal.

Referring to FIGS. 5 and 6, a compressor of the third embodiment includes a housing 10 and pistons 90 instead of the housing 1 and the pistons 9 used in the compressor of the first embodiment.

The housing 10 includes a front housing member 18, a rear housing member 19 similar to that of the first embodiment, and a second cylinder block 23 similar to that of the first embodiment. The front housing member 18 includes a boss 18*a*, which extends toward the front, and a recess 18*b*. A sealing device 25 is arranged in the boss 18*a*. The front housing member 18 differs from the front housing member 17 of the first embodiment in that the front housing member 18 does not include the first suction chamber 27*a* and the first discharge chamber 29*a*.

In the compressor, a swash plate chamber 33 is defined in the front housing member 18 and the second cylinder block 23. The swash plate chamber 33, which is located in the middle portion of the housing 10, is in communication with the second suction chamber 27*b* through a second suction passage 37*b*. A first thrust bearing 35*a* is arranged in a recess 18*b* of the front housing member 18.

The pistons 90 differ from the pistons 9 of the first embodiment in that each piston includes only one piston head 9*b*, which is formed on the rear end. Otherwise, the structure of the piston 90 and the compressor is the same as the first embodiment. To facilitate description of the third embodiment, the second cylinder bores 23*a*, the second compression chambers 23*d*, the second suction chamber 27*b*, and the second discharge chamber 29*b* will be referred to as the cylinder bores 23*a*, the compression chambers 23*d*, the suction chamber 27*b*, and the discharge chamber 29*b*, respectively.

In the compressor, the rotation of the drive shaft 3 rotates the swash plate 5 and reciprocates the pistons 90 in the corresponding cylinder bores 23*a*. The volume of the compression chambers 23*d* changes in accordance with the piston stroke. Refrigerant gas from the evaporator is drawn through the suction port 330 into the swash plate chamber 33. The refrigerant gas is then drawn through the suction chamber 27*b*, compressed in each compression chamber 23*d*, and discharged into the discharge chamber 29*b*. Then, the refrigerant gas is discharged out of the discharge chamber 29*b* from a discharge port (not shown) toward the evaporator.

In the same manner as the compressor of the first embodiment, the compressor changes the inclination angle of the swash plate 5 to control the compressor displacement by lengthening and shortening the stroke of the pistons 90.

Referring to FIG. 6, by reducing the difference between the pressure of the control pressure chamber 13*c* and the pressure of the swash plate chamber 33, the centrifugal force and compression reaction acting on the swash plate 5, the ring plate 45, the lug arm 49, and the first pin 47*a*, which serve as rotation members, move the movable body 13*b* in the swash plate chamber 33 toward the rear along the rotation axis O of the drive shaft 3. Thus, in the same manner as the first embodiment, the swash plate 5 pivots using the action axis M3 as the action point M3 and the first pivot axis M1 as the fulcrum point M1. When the inclination angle of the swash plate 5 decreases and shortens the stroke of the pistons 90, the compression displacement decreases for each rotation of the drive shaft 3. The inclination angle of the swash plate 5 shown in FIG. 6 is the minimum inclination angle of the compressor.

Referring to FIG. 5, when the pressure of the control pressure chamber 13*c* becomes higher than the pressure of the swash plate chamber 33, the movable body 13*b* moves toward the front in the swash plate chamber 33 along the rotation axis O of the drive shaft 3. Thus, the movable body 13*b* pulls the bottom region of the swash plate 5 toward the front of the swash plate chamber 33. This pivots the swash plate 5 in the direction opposite to when decreasing the inclination angle of the swash plate 5 using the action axis M3 as the action point M3 and the first pivot axis M1 as the fulcrum point M1. When the inclination angle of the swash plate 5 increases and lengthens the stroke of the pistons 90, the compression displacement increases for each rotation of the drive shaft 3. The inclination angle of the swash plate 5 shown in FIG. 5 is the maximum inclination angle of the compressor.

The compressor does not include the first cylinder block 21 and the like. This simplifies the structure in comparison with the compressor of the first embodiment. Thus, the compressor may be further reduced in size. Other advantages of the compressor are the same as the compressor of the first embodiment.

Fourth Embodiment

A compressor of the fourth embodiment includes the control mechanism 16 of FIG. 4 in the compressor of the third embodiment. The advantages of the compressor are the same as the second and third embodiments.

The present invention is not restricted to the first to fourth embodiments described above. It should be apparent to those skilled in the art that the present invention may be embodied in many other specific forms without departing from the spirit or scope of the invention. Particularly, it should be understood that the present invention may be embodied in the following forms.

In the first to fourth embodiments, the front surface of the partitioning body 13*a* includes the sloped surface 131 so that the diameter of the partitioning body 13*a* increases toward the surface moved along the movable body 13*b*. Instead, the inner circumferential surface of the main body portion 130*b* of the movable body 13*b* may include a sloped surface that is sloped from the front toward the rear so that the diameter of the movable body increases toward the surface moved along the partitioning body 13*a*.

In the compressors of the first to fourth embodiments, refrigerant gas is drawn into the first and second suction chambers 27*a* and 27*b* through the swash plate chamber 33. Instead, refrigerant gas may be directly drawn into the first and second suction chambers 27*a* and 27*b* from a pipe through a suction port. In this case, the first and second suction chambers 27*a* and 27*h* are in communication with the swash plate chamber 33 in the compressor, and the swash plate chamber 33 is configured to serve as a low pressure chamber.

The pressure regulation chamber 31 may be omitted from the compressors of the first to fourth embodiments.

The present examples and embodiments are to be considered as illustrative and not restrictive, and the invention is not to be limited to the details given herein, but may be modified within the scope and equivalence of the appended claims.

What is claimed is:

1. A variable displacement swash plate compressor comprising:

a housing including a suction chamber, a discharge chamber, a swash plate chamber, and a plurality of cylinder bores;

a drive shaft rotationally supported by the housing;

a swash plate that is rotatable together with the drive shaft in the swash plate chamber;

a link mechanism arranged between the drive shaft and the swash plate, wherein the link mechanism allows for changes in an inclination angle of the swash plate relative to a direction orthogonal to a rotation axis of the drive shaft;

a plurality of pistons reciprocally accommodated in the cylinder bores respectively;

a conversion mechanism that reciprocates each piston in the cylinder bore with a stroke that is in accordance with the inclination angle of the swash plate when the swash plate rotates;

an actuator capable of changing the inclination angle of the swash plate; and a control mechanism that controls the actuator; wherein the actuator is adapted to be rotatable integrally with the drive shaft;

the actuator includes a partitioning body, which is loosely fitted to the drive shaft in the swash plate chamber, a movable body, which is coupled to the swash plate and movable relative to the partitioning body along the rotation axis, and a control pressure chamber, which is defined by the partitioning body and the movable body and moves the movable body by pressure of the control pressure chamber;

at least one of the suction chamber and the swash plate chamber defines a low pressure chamber;

the control mechanism includes a control passage that connects the control pressure chamber, the low pressure chamber, and the discharge chamber, and a control valve capable of adjusting an open degree of the control passage;

the control passage is at least partially formed in the drive shaft; and the movable body is adapted to increase the inclination angle when the pressure of the control pressure chamber increases.

2. The variable displacement swash plate compressor according to claim 1, wherein the movable body includes an outer wall that surrounds the partitioning body and the control pressure chamber, and the outer wall includes an action point where the outer wall and the swash plate are coupled.

3. The variable displacement swash plate compressor according to claim 2, wherein the control passage formed in the drive shaft includes an axial passage, which extends through the drive shaft along the rotation axis, and a radial passage, which extends through the drive shaft in a radial direction and which is connected to the axial passage and the control pressure chamber.

4. The variable displacement swash plate compressor according to claim 1, wherein at least one of an inner circumferential surface of the partitioning body and an inner circumferential surface of the movable body includes at least a portion having a diameter that increases toward a surface where the partitioning body and the movable body move relative to each other.

5. The variable displacement swash plate compressor according to claim 2, wherein the movable body includes a flange that extends away from the rotation axis in a radial direction from around the drive shaft;

the outer wall of the movable body extends along the rotation axis and is integrated with the flange at an outer rim of the flange; and the outer wall of the movable body is movable along the rotation axis relative to an outer rim of the partitioning body.

6. The variable displacement swash plate compressor according to claim 1, wherein the control valve is configured to lower the pressure of the control pressure chamber when a thermal load decreases.

* * * * *